United States Patent [19]

Kytönen

[11] Patent Number: 4,635,867

[45] Date of Patent: Jan. 13, 1987

[54] WEB WINDING METHOD AND APPARATUS

[75] Inventor: Pauli Kytönen, Riihikallio, Finland

[73] Assignee: Oy Wartsila Ab, Helsinki, Finland

[21] Appl. No.: 750,040

[22] Filed: Jun. 28, 1985

Related U.S. Application Data

[63] Continuation of Ser. No. 601,268, Apr. 17, 1984, abandoned.

[30] Foreign Application Priority Data

May 3, 1983 [FI] Finland ..... 831507

[51] Int. Cl.[4] ..... B65H 19/26; B65H 18/20; B65H 19/30

[52] U.S. Cl. ..... 242/56 R; 242/66

[58] Field of Search ..... 242/56 R, 56.6, 66, 242/64, 56˙A

[56] References Cited

U.S. PATENT DOCUMENTS 3,841,578 10/1974 Dorfel ..... 242/66
4,456,190 6/1984 Karttunen et al. ..... 242/56 R
4,485,979 12/1984 Dropczynski ..... 242/56 R
4,485,980 12/1984 Gorner ..... 242/56 R

FOREIGN PATENT DOCUMENTS 2065081 6/1981 United Kingdom .

*Primary Examiner*—John Petrakes
*Attorney, Agent, or Firm*—Dellett, Smith-Hill and Bedell

[57] ABSTRACT

An arrangement for winding a web, in particular a paper web, onto a roll core or the like in a two-drum winder comprising a first and a second support drum and a rider roll surrounding said roll core, which is located in a web winding position. The arrangement comprises further a web cutter, means for the transfer of a finished roll to move the roll away from said support drums to a receiving device and supply means for the supply of a new roll core. The roll transfer and the new core supply are carried out before said web cutter disengages said finished roll from said web. Said web cutter is supported at a movable support member of said rider roll. The cutter is arranged to engage said web at a location between the web winding position and the finished roll, which is located in the receiving device.

18 Claims, 3 Drawing Figures

WEB WINDING METHOD AND APPARATUS

CROSS-REFERENCE TO RELATED APPLICATION

This is a continuation of co-pending application Ser. No. 601,268 filed Apr. 17, 1984, now abandoned.

BACKGROUND OF THE INVENTION

The invention relates to an arrangement for winding a web on a roll core or the like in a support drum winder, which comprises a first and a second support drum, a rider roll, a web cutter, transfer devices for the transfer of a complete roll from the support drums and a supply device for a new roll core.

In a web winding process, the usual measure is to cut the web prior to the transfer of the complete wound roll away from the support drums. The supply of a new roll core is carried out thereafter into the winding position. As measures carried out one after another, they require a long breakdown time in the support drum winder, which delay is uneconomical. Trials have been made to eliminate this defect by supplying the new core into the winding position simultaneously with the removal of the complete roll. It has proven difficult however, to control the guidance of a new web end around the supplied core.

OBJECTS AND SUMMARY OF THE INVENTION

The object of the invention is to provide such an arrangement, in which the web is reliably guided around a new core so that measures in connection with the complete roll and the necessary functions in connection with a restart of the winding process for a new roll can be carried out without unnecessary delays.

The time-saving object is accomplished by carrying out both the transfer of the complete roll from the support drums to the receiving member and the supply of a new core into the winding position prior the web cutting, and by associating the cutting measure with actions taken by a movable member of the rider roll. By this means the lost time spent during the roll transfer and the starting of a new winding process is most economically exploited. Prior to the web cutting the core is hereby brought in contact with the web so that no folds are formed in the web. The cutter engagement with the web is arranged at a web location between the complete roll and the winding position. Prior to the web cutting, therefore, the new web leading end for the following winding process has already passed the space between the rider roll and the new core. This facilitates a reliable guidance of the new leading end around the core.

In one embodiment of the invention the web cutting is carried out at a web location which is in the vicinity of the new roll core received in the winding position. A preferred cutting location is at a distance corresponding to three times the core diameter at the most. The cutting efficiency can be increased by arranging for the web to be gripped between the rider roll and the new core prior to the cutting action.

The engagement of the cutter with the web can be arranged by forcing the web against the cutter. This is possible by moving the roll located in the receiving member away from the winding position. By this means the own motion of the complete roll is easily exploited. The cutting can also be so arranged that the cutter directs a vertical stroke or a horizontal shear action against the web.

Moving the new core over the second support drum into the winding position is a favourable way of supplying the core. The supply device is hereby located between the winding arrangement and the roll receiving device. The adjustment of the new core in its axial direction relative to the winding position or the web is hereby easily governed. This effect can be increased by precisely adjusting the core in its axial direction, so that the supply device is rotatably supported at the shaft or the bearing housing of the second drum. The interaction between the web and the core, prior to the web cutting, is easily controlled so that the new core received in the winding position is forced against the second support drum, by said web, which is held tight between the complete roll and the winding position.

BRIEF DESCRIPTION OF THE DRAWING

The invention is described in the following with reference to the attached drawing in which FIG. 1 discloses as a side view the final stage of the web winding before the supply of a new core, FIG. 2 discloses a winding stage after the supply of the new core and before the cutting of the web and FIG. 3 discloses a stage just after the web cutting.

DESCRIPTION OF A PREFERRED EMBODIMENT OF THE INVENTION

Figure 1:
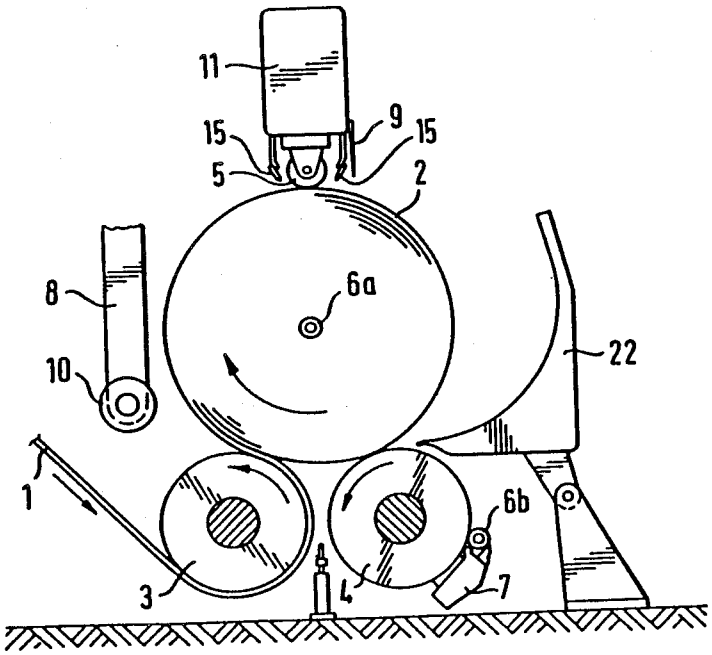

In FIG. 1 is disclosed the final winding stage of a web 1 around a core 6*a*. A nearly completed roll 2 is compressed against support drums 3,4 by the rider roll 5. A new core 6*b* is located in a supply device 7. The web winding arrangement comprises a pusher roll 10 journalled at a support arm 8 and a cutter 9, which is attached to a support device 11 of rider roll 5. Pusher roll 10 and a receiving descendable device 22 for the reception of roll 2 are located at opposite sides of the support drum winder. The motion directions of the web, the roll and the support drums are shown by arrows.

Figure 2:
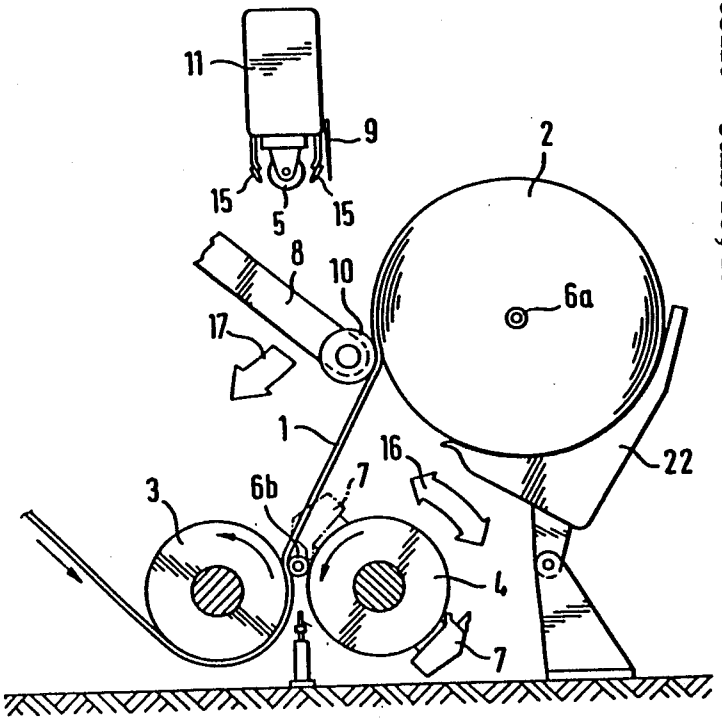

Roll 2 is pushed into descender device 22 in the stage disclosed in FIG. 2. As a result of the pushing action of pusher 10, roll 2 has a slow rolling motion, which stops when roll 2 is firmly in the grab of the descender device. Supply device 7 has supplied new core 6*b* into the winding position so that device 7 is rotated over second drum 4 (open arrow 16). By means of the tight held web 1, core 6*b* is forced against second drum 4. The tension of web 1 can be adjusted by means of the descending motion of descender 22. Drums 3,4 are rotated either at the idling speed or the so-called crawling speed. Their slow rotation can also be carried out by the rolling motion of roll 2 altered to a rotation motion by means of idle rollers located in the descender cradle, as known per se. As a result, the web transmits the motion further. Hereby web 1 rotates drum 3 and core 6*b*, from which the motion is transferred to drum 4. The disclosed stage is followed by the return motion (open arrow 17) of pusher 10 and the downwards directed motion of support device 11.

Figure 3:
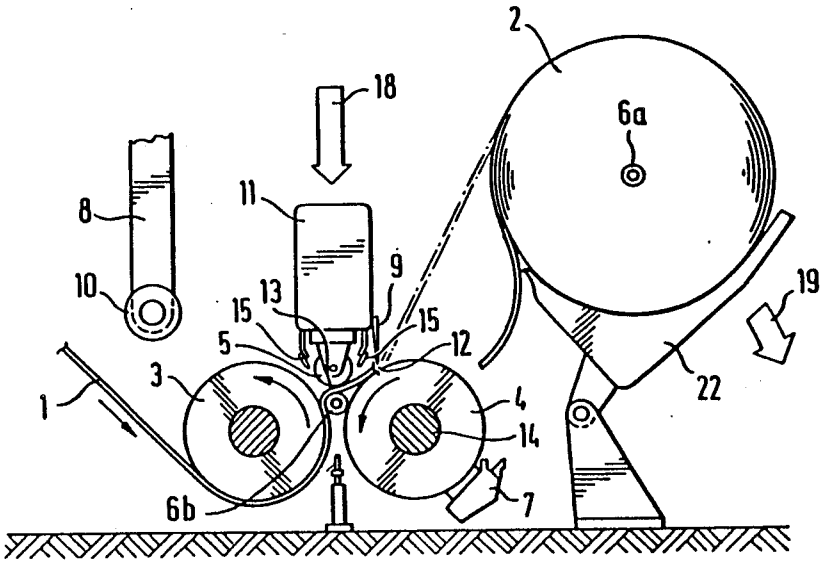

Pusher 10 is in its initial location and support drums 3,4 set to crawling speed in FIG. 3. Rider roll 5 is brought into contact with web 1 by the motion (open arrow 18) of the support device 11, whereby web 1 is held against core 6*b*. At the same time, cutter 9 cuts the web at a position between a nip 13 formed by rider roll 5 and core 6*b* and the complete roll 2. The next winding process is, thus, provided by a new web leading end, which has already passed the nip 13 or the space between core 6b and rider roll 5 prior their interaction. The cutting position 12 is so arranged that a new leading end of the web is easily brought into the next winding member, namely a nip between core 6b and drum 4. The guidance of the leading end can be carried out, as shematically shown in the Figure, by pneumatic guiding nozzles 15, located at both sides of rider roll 5 and below core 6b between drums 3,4. Supply device 7 can be rotatably supported at bearing housing of a shaft 14. The complete roll located in descender device 22 is lowered (open arrow 19) for further measures. The attachment of the trailing web end of roll 2, to the roll 2 is not shown more in details because it is not within the scope of the actual invention.

The web cutting action at position 12 can be carried out by several alternative ways. Prior to the cutting, web 1 can rest against a knife- or saw-like edge of cutter 9. Tear-off cutting is achieved by moving the heavy roll 2 away from the winding arrangement either by its rotation in descender cradle or by the descending motion 19. Web 1 will hereby be moved against cutter 9. In other alternatives, as obvious to a skilled man from the following description, web 1 can rest against a back-up member located in the vicinity of the cutter edge, which will direct a vertical stroke or a horizontal shearing action against web 1.

DESCRIPTION OF ANOTHER EMBODIMENT OF THE INVENTION

Prior its cutting from complete roll 2, web 1 can be provided, for example, with a glue stripe at a position, which is spaced from the planned cutting position of the web towards first support drum 3. This stripe is so arranged that during the web passage through nip 13, web 1 is attached to core 6b. The glue stripe and nip 13 can be nearly at equal distances from cutting position 12, when the attachment starts. The stripe is provided on that web surface, which is not in contact with first support drum 3. The glue stripe can be arranged on said web surface by several alternative methods and devices, as known to a man skilled in the art. Hence, the stripe supply arrangment is not described more in details. It is understandable, however, that a sufficient requirement is that the stripe should extend axially over new core 6b, either uninterrupted or spot-wise distributed.

The invention is not limited to the embodiment shown, but several modifications thereof are feasible within the scope of the attached claims.

I claim:

1. A method of winding a web onto a succession of take-up members, comprising:

(a) locating a first take-up member in a web winding position defined between first and second support drums with a leading end of the web gripped between the take-up member and a rider member;

(b) rotating the drums so as to rotate the take-up member and thereby cause the web to be wound onto the take-up member to form a roll thereon while the rider member remains in contact with the roll and, when the roll is finished, withdrawing the rider member from contact with the roll and transferring the roll away from the support drums to a receiving position;

(c) after steb (b), supplying a new take-up member to the web winding position, bringing the rider member into a position in which the web is gripped in a nip defined between the rider member and the new take-up member, and severing the web from the finished roll at a location between the nip and the finished roll, so as to define a new leading end of the web, the new leading end of the web being gripped in the nip between the rider member and the new take-up member, and (d) repeating steps (b) and (c).

2. A method according to claim 1, wherein, in step (b), the finished roll is moved from the receiving position to a position that is vertically higher than the second drum, so that a gap is formed between the second drum and the roll, and in step (c) the new take-up member is supplied to the web winding position from a position on the opposite side of the second drum from the web winding position by moving the new take-up member over the second drum and through the gap between the second drum and the finished roll.

3. A method according to claim 1, wherein the rider member is supported by a support member and the web is severed from the finished roll by using a cutter member that is stationary relative to the support member, by moving the support member into a position in which the web is gripped between the rider member and the new take-up member and the cutter member contacts the web at a location between the new take-up member and the finished roll.

4. Apparatus for winding a web onto a roll take-up member, comprising first and second support drums defining a web winding position therebetween, a rider roll mounted to engage a roll being formed on the take-up member when positioned in the web winding position, a support member supporting the rider roll to permit movement thereof relative to the support drums, means defining a receiving position for a finished roll, means for transferring the finished roll from the web winding position to the receiving position, and means for supplying a new roll take-up member to the web winding position when the finished roll has been transferred from the web winding position, the support member being movable to bring the rider roll into a position in which it defines a nip with the new roll take-up member in the web winding position and the web is gripped between the rider roll and new roll take-up member, and the apparatus also comprising a cutter member that is stationary relative to the support member and is effective when the finished roll is in the receiving position and the rider roll is in the position in which it defines a nip with the new roll take-up member to contact the web at a location between the nip and the finished roll and sever the web at that location.

5. Apparatus according to claim 4, wherein the severing location is in the vicinity of the nip.

6. Apparatus according to claim 5, wherein the severing location is at a distance of up to three times the diameter of the new take-up member from the nip.

7. Apparatus according to claim 4, wherein the means defining the receiving position comprise a receiving device which is movable so as to move the finished roll from the receiving position farther away from the winding position and bring about movement of the web into contact with the cutter member.

8. Apparatus according to claim 4, wherein the cutter member is arranged to execute a vertical stroke when the rider roll is brought into the position in which it defines a nip with the new roll take-up member.

9. Apparatus according to claim 8, wherein the means defining the receiving position comprise a receiving device which is movable so as to move the finished roll from the receiving position in a direction away from the web-winding position, whereby the web is maintained under tension between the nip and the finished roll.

10. Apparatus according to claim 4, wherein the finished roll passes over the second support drum on being transferred from the web winding position to the receiving position, and the supply means supply the new roll take-up member into the web winding position from a position on the opposite side of the second support drum from the web winding position, whereby the new roll, take-up member passes over the second support drum.

11. Apparatus according to claim 10, wherein the means defining the receiving position comprise a receiving device which is movable so as to move the finished roll from the receiving position to a position that is vertically higher that the second support drum, so that a gap is formed between the second support drum and the finished roll, and the supply means are operative to supply the new take-up member through the gap between the second drum and the finished roll.

12. Apparatus according to claim 10, in which the supply means are mounted to rotate about the central axis of the second support drum.

13. Apparatus according to claim 4, arranged so that the new take-up member, in the web winding position, is forced against the second support drum by the web.

14. Apparatus according to claim 4, wherein the means for transferring the finished roll from the web-winding position to the receiving position operates by rolling the finished roll over the second drum, whereby the finished toll undergoes a rolling motion and maintains the web under tension so that the new take-up member, in the web winding position, is forced against the second support drum by tension in the web prior to the rider roll's reaching the position in which it defines a nip with the new take-up member.

15. Apparatus according to claim 14, wherein the cutter member contacts the web at the severing location when the support member is moved to bring the rider roll into contact with the new take-up member, whereby the web is severed and a new leading end is formed, and the apparatus further comprises means for guiding the new leading end around the new take-up member.

16. Apparatus according to claim 15, wherein the guiding means comprise a pneumatic device mounted in the support member for guiding the new leading end of the web into a nip between the new take-up member and said second drum.

17. Apparatus according to claim 4, wherein the central axes of the drums are horizontal and the central axes of rolls in the web-winding position and the receiving position are horizontal, and the severing location is located between the nip and an imaginary vertical plane extending through the central axis of the second drum.

18. Apparatus according to claim 4, comprising means for applying glue to the new leading end of the web on a side of the web that does not contact the first drum and at a location upstream with respect to the direction of web movement from the nip between the rider roll and the new take-up member, whereby the new leading end is attached to a new take-up member.

* * * * *